US006012804A

United States Patent [19]

Mitani

[11] Patent Number: 6,012,804

[45] Date of Patent: Jan. 11, 2000

[54] INK JET RECORDING HEAD

[76] Inventor: Masao Mitani, No.54-1, Sawatari, Kanagawa-ku, Yokohama-shi, Kanagawa-ken, Japan

[21] Appl. No.: 09/159,635

[22] Filed: Sep. 24, 1998

[30] Foreign Application Priority Data

Sep. 24, 1997 [JP] Japan ..... P9-296105

[51] Int. Cl.[7] ..... B41J 2/05

[52] U.S. Cl. ..... 347/64; 347/56; 347/62

[58] Field of Search ..... 347/64, 65, 67, 347/20, 54, 56, 62, 63

[56] References Cited

U.S. PATENT DOCUMENTS 5,831,648 11/1998 Mitani et al. ..... 347/62

FOREIGN PATENT DOCUMENTS 48-9622 2/1973 Japan .

54-51837 4/1979 Japan .

8-238771 9/1996 Japan .

OTHER PUBLICATIONS

*Nikkei Mechanical*, Dec. 12, 1988, pp. 58–63.

Baker, J., et al., "Design and development of a color thermal inkjet print cartridge," *Hewlett–Packard Journal*, Aug., 1998, pp. 6–15.

Mitani, M., et al., "Bubble pressure imposed upon thermal ink–jek heaters," *Japan Hard Copy*, 1996, p. 169.

*Primary Examiner*—John Barlow
*Assistant Examiner*—Juanita Stephens
*Attorney, Agent, or Firm*—Whitham, Curtis & Whitham

[57] ABSTRACT

In an ink jet recording head of the type in which a bubble generated in ink filling an ink channel ejects an ink droplet, a thin-film resistor that generates the bubble is protected from cavitation damage. To this effect, a particular portion of the resistor is covered with a tantalum layer. The thickness of the tantalum layer is from 0.1 to 0.2 microns.

7 Claims, 3 Drawing Sheets

INK JET RECORDING HEAD

BACKGROUND OF THE INVENTION

1. Field of the Invention

The present invention relates to an ink jet recording head that uses heat energy to eject ink droplets toward a recording medium.

2. Description of the Related Art

Japanese Patent Application Laid-Open Publication (Kokai) Nos. SHO-48-9622 and SHO-54-51837 disclose ink jet recording devices with a print head that uses a pulse of heat to rapidly vaporize a portion of ink filling an ink channel. The expansion of the vaporized ink ejects an ink droplet from an orifice in the print head. The simplest method for developing the pulse of heat is to energize a thin-film resistor with a pulse of voltage. Specific configurations for print heads including thin-film resistors are disclosed in the Dec. 12, 1988 edition of Nikkei Mechanical (page 58) and in the August 1988 edition of Hewlett-Packard Journal.

A conventional heater includes a thin-film resistor and conductor. Because the heater is used in a water-based electrolyte ink, protective layers are required for protecting the thin-film resistor and conductor against oxidation, corrosion, galvanization, and cavitation. For this reason, the thin-film resistor and conductor are covered with an approximately 3.0 $\mu$m thick anti-oxidation protective layer. The anti-oxidation protection layer is further covered with an approximately 0.5 $\mu$m thick anti-activation protective layer. The anti-activation protective layer is formed from a Ta metal thin-film.

An energy of 15–30 $\mu$Joule/pulse is required to heat ink through the two protective layers. However, most of this energy is consumed as heat that escapes through the substrate of the head. Also, the volume of ejected droplets is liable to be varied, resulting in fluctuation in density of printed images.

Japanese Patent Application Laid-Open Publication (Kokai) No. HEI-08-238771 discloses a method for forming a protection-layerless Ta—Si—O tertiary alloy thin-film resistor. An oxidation layer having a thickness of 10 to 20 nm is formed on the surface of the thin-film resistor using thermal oxidation. The oxidation layer has superior electric insulation properties and mechanical strength and so prevents oxidation, corrosion, and galvanization of the thin-film resistor. Further, energy required to eject a droplet is reduced to about 2.5 $\mu$Joule/pulse.

In order to make maximum advantage of the properties of the Ta—Si—O tertiary alloy thin-film resistor, the thin-film conductor used with the Ta—Si—O tertiary alloy thin-film resistor must also be made from a material that is not corroded by ink. The present inventor discovered that nickel or nickel subjected to metal plating is the optimum material for the thin-film conductor.

Also, the present inventor proposed methods for preventing galvanization of the thin-film conductor, in which the thin-film conductor disposed adjacent to an individual electrode is covered with a thermal resistant resin partition.

Japanese Patent Application Laid-Open Publication (Kokai) No. HEI-8-238771 and Japan Hard Copy '96 (page 169), which was published in July 1996 for the Annual Conference of Japan Hardcopy for the Society of Electrophotography of Japan, disclose a head structure that can protect the thin-film resistor from cavitation damage. Protecting the thin-film resistor from cavitation damage can increase the life of the head.

When the thin-film resistor and its driver circuit are formed on the same silicon wafer, then thermal oxidation of the Ta—Si—O tertiary alloy thin-film resistor must be performed at a low temperature. However, when the temperature used during thermal oxidation of the Ta—Si—O tertiary alloy thin-film resistor is low, the resultant oxidation layer can be thinner than 10 nm. Such a thin-film has insufficient strength to protect the thin-film resistor to reliably guarantee a head life of 100 million pulses or more.

SUMMARY OF THE INVENTION

It is an object of the present invention to provide an ink jet recording head having a sufficiently long head life, but does not require a great deal of energy to eject ink droplets, wherein an oxidation layer is formed on a thin-film resistor by performing thermal oxidation at a low temperature.

To achieve the above and other objects, there is provided an ink jet recording head that includes a plurality of heaters formed on a substrate and aligned at a predetermined interval. The heater includes a thin-film resistor, an individual thin-film conductor, and a common thin-film conductor portion. The thin-film resistor has a surface defined by a first side line, a second side line, a first width line, and a second width line. The individual thin-film conductor is connected to the second width line, and a common thin-film conductor portion is connected to the first width line. The individual thin-film heater is divided by a boundary line in parallel to the first width line and the second width line into a first width portion having a first width and a second width portion having a second width. The second width is at least 10% wider than the first width. An electrically insulating oxidized film is formed over the surface of the thin-film resistor. A tantalum thin-films is formed over a portion including a part of the first width portion and the second width portion to cover corresponding electrically insulating oxidized film formed over the surface of the thin-film resistor. A thermal resistant resin layer covers the second width portion and the individual thin-film conductor. A nozzle plate formed with a plurality of orifices corresponding to respective ones of the plurality of heaters is attached to the thermal resistant resin layer.

It is preferable that the tantalum thin-films protrudes at least 3 to 5 microns into the first width portion from the boundary line. It is sufficient for the tantalum thin-films to have a thickness in a range from 0.1 to 0.2 microns.

BRIEF DESCRIPTION OF THE DRAWINGS

The above and other objects, features and advantages of the invention will become more apparent from reading the following description of the preferred embodiment taken in connection with the accompanying drawings in which:

FIG. 3(*b*) is an explanatory diagram showing a tantalum thin-film formed on the arrangement shown in FIG. 3(*a*); and FIG. 3(*c*) is an explanatory diagram showing a thermal resistant resin layer formed over the arrangement shown in FIG. 3(*b*).

DETAILED DESCRIPTION OF THE PREFERRED EMBODIMENTS

For a better understanding of the present invention, an ink jet recording head according to a preferred embodiment of the present invention will be described with reference to the accompanying drawings.

Figure 1:
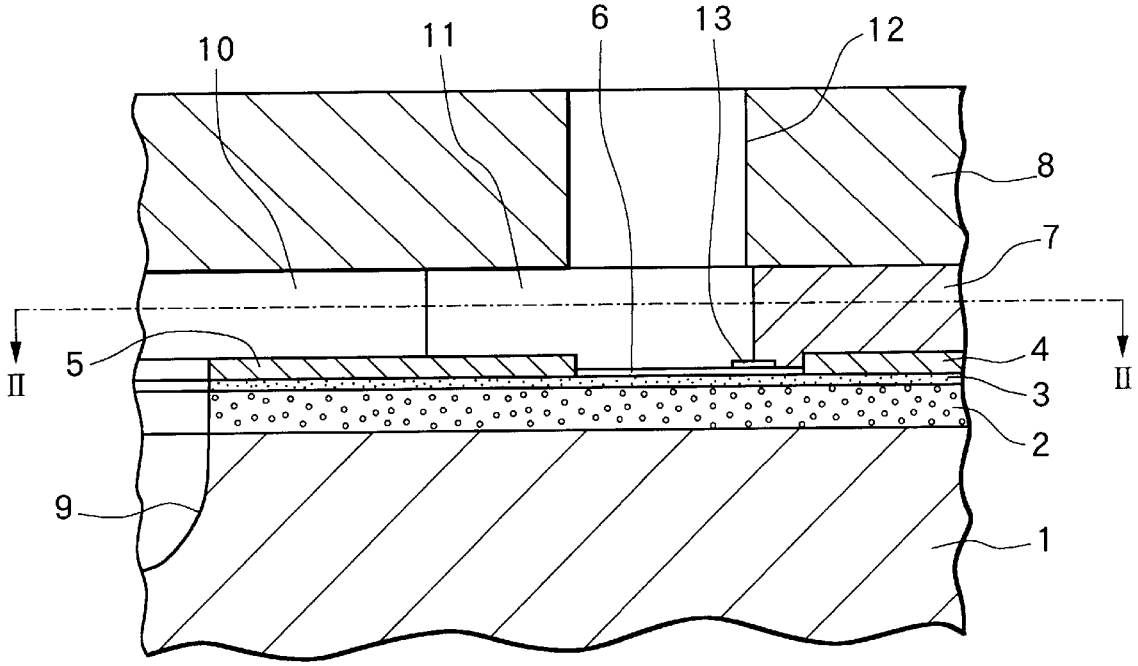
FIG. 1 is a cross-sectional view showing an ink jet print head according to an embodiment of the present invention.
Figure 2:
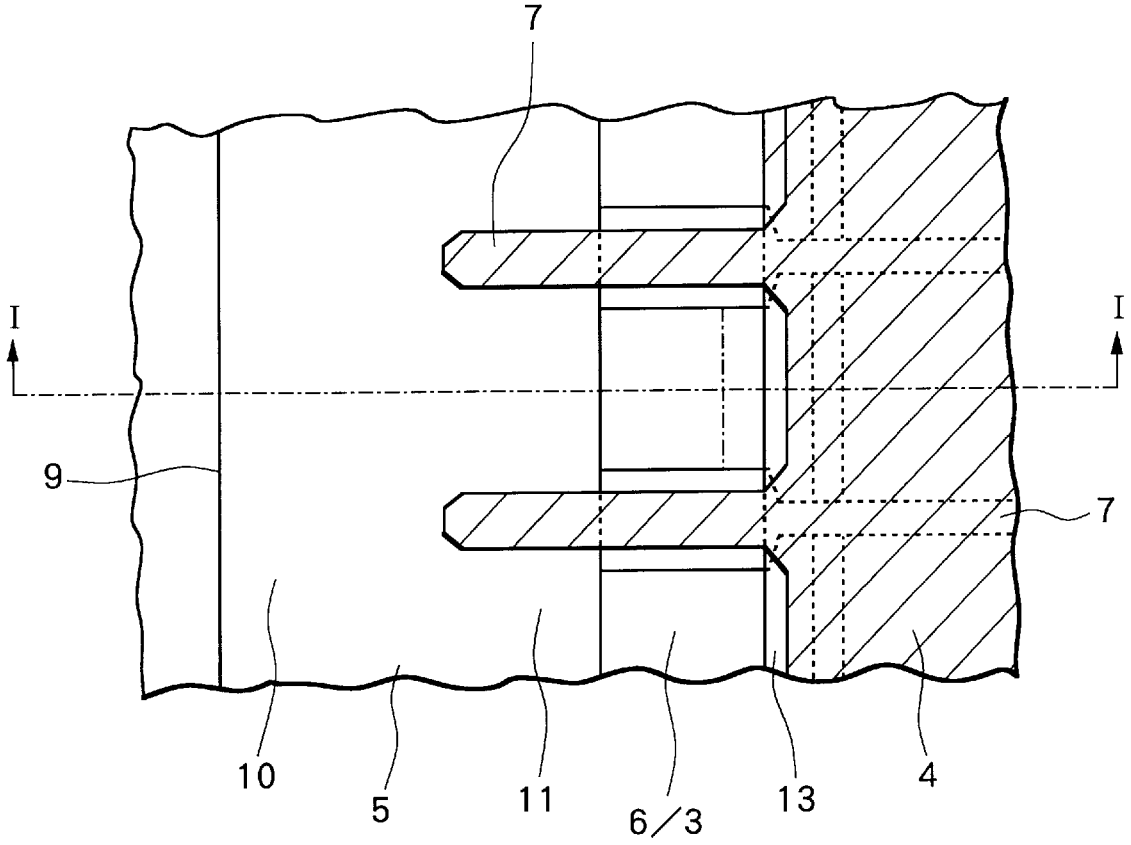
FIG. 2 is a cross-sectional view taken along line II—II of FIG. 1.

As shown in FIGS. 1 and 2, the head includes a silicon substrate 1, an $SiO_2$ 2, and a polyimide film orifice plate 8. The orifice plate 8 is formed with a plurality of orifices 12. In this example, 128 orifices 12 are formed at a pitch of 360 dots per inch (dpi). An ink conduit 9*a* defined by a conduit wall 9 is formed through the silicon substrate 1 and the $SiO_2$ 2. A plurality individual ink channels 11 are formed which are in fluid communication with respective ones of the plurality of orifices 12. A common ink channel 10 connects the ink conduit 9*a* with the individual ink channels 11. Although not shown in the drawings, an ink supply port is formed in the lower surface of the substrate 1 in fluid connection with the ink conduit 9*a*.

A thin-film resistor 3 is formed in opposition with each orifice 12. An individual thin-film conductor 4 is formed in contact with one side of the thin-film resistor 3 and a common thin-film conductor 5 is formed in contact with the other side of the thin-film resistor 3.

Figure 3:
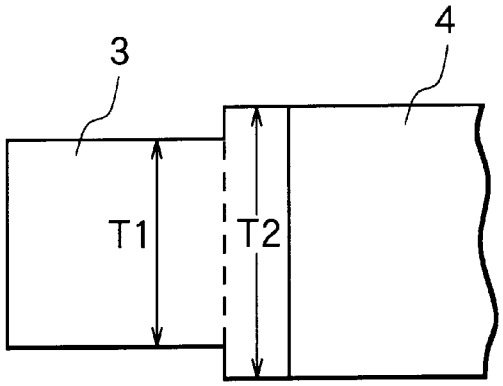
FIG. 3(*a*) is an explanatory diagram showing a thin-film resistor and an individual thin-film conductor.
Figure 3:
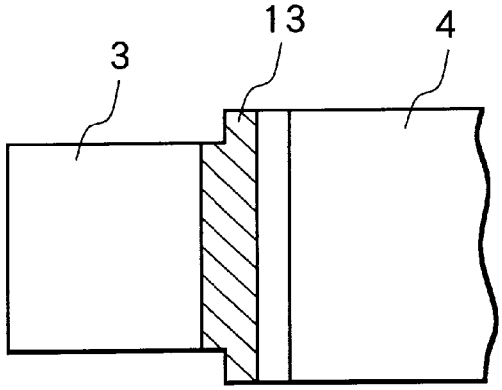
Figure 3:
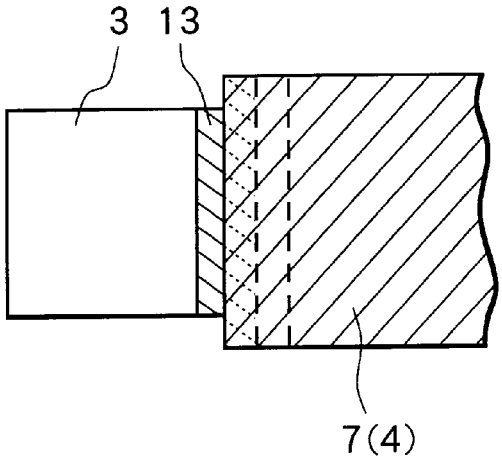

As shown in FIG. 3(*a*), the thin-film resistor 3 is divided into a small-width portion having a width T1 and a large-width portion having a width T2 10% to 25% wider than the width T1. The width T2 relative to the width T1 is determined based on a distance between two adjacent heaters. The individual thin-film conductor 4 is connected to the edge of the large-width portion and has a width substantially equal to the width T2.

The conductors 4 and 5 are formed from a nickel metal layer or a nickel subjected to gold plating, which provides excellent resistance to corrosion.

When the thin-film resistor 3 is thermally oxidized at a temperature of 400° C., an oxidation layer 6 of 10 nm thickness or more is formed. The oxidation layer having such a thickness sufficiently protects the thin-film resistor 3 from electrolytic ink. However, when a driver circuit is mounted on the same substrate 1, the thermal oxidation process for developing the oxidation layer 6 must be performed at a temperature lower than 400° C., say 380° C. When thermal oxidation is performed at such low temperatures, the resultant oxidation layer will be too thin to guarantee that all of the heaters in the wafer will have a life of 100 million pulses.

Those thin-film resistors with a life of only 30 to 50 million pulses were observed to determine the cause of heater break down. It was determined that all these heaters stopped performing because the portion of the heater near the rear-most part of the individual ink conduit 11 became severed. No abnormality was observed at other portions of the heaters. These observations match presumptions given in Japan Hard Copy '96 (page 169), which was published in July 1996 for the Annual Conference of Japan Hardcopy for the Society of Electrophotography of Japan. This publication suggests that the destructive force of cavitation is much less in top shooter type print heads with cylindrical shaped orifices, similar to that shown in FIG. 1, and also that only a small amount of destructive force remains in the rear-most part of the individual ink conduit 11.

According to the present invention, as shown in FIGS. 1, 2 and 3(*b*), a tantalum (Ta) thin-film 13 is partially formed on the oxidation layer 6. The Ta thin-film 13 is formed in part of the small-width portion adjacent to the large-width portion and also in a part of the large-width portion. The Ta thin-film 13 is formed continuously. Also, the Ta thin-film 13 is formed in non-overlapping relation with the individual thin-film conductor 4.

As shown in FIG. 3(*c*) the Ta metal thin-film 13 is positioned so as to be partially covered by a heat resistant resin partition 7. The Ta metal thin-film 13 protrudes at least 3 to 5 microns into the small-width portion. When the Ta metal thin-film 13 is formed at this position, the region of the thin-film resistor where nucleation boiling occurs will be the same as that of the head with no provision of the Ta metal thin-film 13. Moreover, the damaging force of cavitation will be applied at the position covered by the Ta metal thin-film 13, which has excellent anti-cavitation properties. Further, the oxidation layer 6 will prevent short circuits from occurring even when, as shown in FIG. 2, the Ta metal thin-film 13 is formed on the thin-film resistor 3.

Alternatively, the Ta metal thin-film 13 can be formed separately for each thin-film resistor 3 using lift off as described below. However, when a Ta metal thin-film 13 is formed separately for each thin-film resistor 3, it can be formed to overlap the individual thin-film conductor 4.

It is necessary to form the Ta metal thin-film 13 according to lift off technique, because etching technique cannot be used in this situation. If the etching technique is used, the following process needs to be taken. After the oxidation layer 6 is formed using the thermal oxidation process, the Ta metal thin-film 13 is sputtered on the resultant thin-film resistor. Then, the Ta metal thin-film 13 is to be photoetched into the shape shown in FIGS. 1 and 2. However, during the etching process, the thin-film resistors 6/3 and the thin-film conductors 4, 5 are also etched away, because there is no etching liquid that selectively etches Ta and Ni metals and Ta—Si—O tertiary alloy.

For this reason, a lift off technique is used wherein a photoresist is formed on the thin-film resistor after the thermal oxidation process. Then, in a first resist removing process, the resist is removed from positions where the Ta metal thin-film 13 is to be formed. After, a Ta metal thin-film 13 is formed using sputtering. Then, in a second resist removing process, all the remaining resist layer is removed, whereupon the Ta metal thin-film formed on the resist layer is removed also. As a result, only the Ta metal thin-film 13 remains because it is positioned at the location where the resist was removed during the first resist removing process.

It is generally known that one important condition a lift off process to be properly performed is that the resist must be formed to a thickness that is sufficiently thicker than the thin-film to be formed. The August 1998 edition of Hewlett-Packard Journal discloses that a Ta metal thin-film must be formed to 0.5 to 0.6 $\mu$m to prevent cavitation in an open pool situation. Because the heads with the configurations shown in FIGS. 1 and 2 reduce the destructive force of cavitation to 1/10 to 1/50, predicted and confirmed in tests, as will be described later, that the Ta metal thin-film 13 need only be about 0.1 to 0.2 $\mu$m thick. Accordingly, the resist layer used during lift off processes will be sufficiently thick if formed from 1.0 to 2.0 $\mu$m thick. This thickness of 1.0 to 2.0 $\mu$m is within the range possible for general photoetching techniques.

Further, thin-film patterns can be positioned using lift off processes with a precision of about 1.0 $\mu$m. Because the thin-film resistors shown in FIGS. 1 and 2 are aligned at a pitch of 70 $\mu$m, which translates into 360 dpi, the present invention can be easily used in the thin-film resistors shown in FIGS. 1 and 2. Further, the present invention can be easily used in thin-film resistors aligned at a pitch of 35 $\mu$m (720 dpi), which is a pitch that has not been achieved previously.

Trial heads for evaluation purposes were produced in the following manner. First, the partition 7 of the trial head was formed from polyimide resin to a thickness of about 10 μm. Then, a polyimide film having a thickness of 35 μm was stretched over partition 7. Afterward, the cylindrical nozzles 12 were photoetched in the polyimide film. In one trial head type the Ta metal thin-film 13 was formed to a thickness of 0.1 μm and in another trial head type to a thickness of 0.2 μm, the region of the thin-film resistor where nucleation boiling was generated was 45 $\mu m^2$ and had a resistance value of about 120 ohms. The thin-film resistor was thermally oxidized at an average temperature of 380° C., with temperature of the silicon wafer varying by ±20° C. Ink used during ink ejection trials was a water-based ink used in a commercially available ink jet printer.

Ink ejection trials were performed by applying pulses of 3 μJoule/pulse energy to the head. Ejection of ink was properly performed for up to 100 million pulses regardless of the thickness (0.1 μm and 0.2 μm) of the Ta metal thin-film 13. It was confirmed that no problems arose when the Ta metal thin-film 13 protruded from the partition 7 into the individual ink conduit 11 by at least 3 to 5 μm. However, some cases were observed of the thin-film resistors severing and reliability dropping when the Ta metal thin-film 13 protruded from the partition 7 by only 3 μm or less.

According to the present invention, even a thin-film resistor that has only a thin oxidized film formed thereon by thermal oxidation performed at a low temperature can have a sufficiently long life without increasing the energy required to eject droplets. Therefore, a large-scale integrated ink jet print head with an internal driver circuit and with low energy consumption can be produced.

With this configuration, ink that is supplied through the ink supply port passes through the ink conduit 9*a* and the common ink channel 10 and is introduced into the individual ink channels 11. When a pulse of voltage is applied to the thin-film resistor 3, an ink droplet is ejected from the corresponding orifice 12.

While the invention has been described in detail with reference to a specific embodiment thereof, it would be apparent to those skilled in the art that various changes and modifications may be made therein without departing from the spirit of the invention, the scope of which is defined by the attached claims.

What is claimed is:

1. An ink jet recording head comprising:

a substrate;

a plurality of heaters formed on said substrate and aligned at a predetermined interval, each of said plurality of heaters including a thin-film resistor having a surface defined by a first side line, a second side line, a first width line and a second width line, an individual thin-film conductor connected to the second width line, and a common thin-film conductor portion connected to the first width line, a plurality of common thin-film conductor portions of said plurality of heaters being connected together to form a common thin-film conductor, wherein the individual thin-film heater being divided by a boundary line in parallel to the first width line and the second width line into a first width portion having a first width and a second width portion having a second width at least 10% wider than the first width;

a plurality of electrically insulating oxidized films provided corresponding to respective ones of said plurality of heaters, each of said plurality of electrically insulating oxidized films being formed over the surface of the thin-film resistor;

a plurality of tantalum thin-films formed on a portion of said plurality of heaters, each of said plurality of tantalum thin-films being formed over a portion including a part of the first width portion and the second width portion to cover corresponding electrically insulating oxidized film formed over the surface of the thin-film resistor;

a thermal resistant resin layer covering the second width portion and the individual thin-film conductor; and a nozzle plate formed with a plurality of orifices corresponding to respective ones of said plurality of heaters.

2. The ink jet recording head as claimed in claim 1, wherein each of said plurality of tantalum thin-films protrudes at least 3 to 5 microns into the first width portion from the boundary line.

3. The ink jet recording head as claimed in claim 2, wherein each of said plurality of tantalum thin-films has a thickness in a range from 0.1 to 0.2 microns.

4. The ink jet recording head as claimed in claim 1, wherein said thermal resistant resin layer extends along the first side line and the second side line outside the thin-film resistor to define an individual ink channel in fluid communication with a corresponding orifice.

5. The ink jet recording head as claimed in claim 1, wherein the thin-film resistor is formed from Ta—Si—O tertiary alloy having a composition of 64%<Ta<85%, 5%<Si<26%, and 6%<O<15%.

6. The ink jet recording head as claimed in claim 1 wherein the individual thin-film conductor comprises a nickel plate.

7. The ink jet recording head as claimed in claim 1, wherein the individual thin-film conductor comprises a nickel plate having a plating of gold.

* * * * *